US007832659B1

(12) United States Patent
Collins

(10) Patent No.: US 7,832,659 B1
(45) Date of Patent: Nov. 16, 2010

(54) RISER ASSEMBLY FOR USE WITH FLUID SPRINKLER

(76) Inventor: Wade E. Collins, P.O. Box 296, Arco, ID (US) 83213

( * ) Notice: Subject to any disclaimer, the term of this patent is extended or adjusted under 35 U.S.C. 154(b) by 208 days.

(21) Appl. No.: 11/983,273

(22) Filed: Nov. 8, 2007

(51) Int. Cl.
*B05B 15/06* (2006.01)

(52) U.S. Cl. ..... 239/201; 239/69; 239/285

(58) Field of Classification Search ..... 239/63–65, 239/67–74, 200–206, 279, 285
See application file for complete search history.

(56) References Cited

U.S. PATENT DOCUMENTS 4,014,359 A * 3/1977 Sanner ..... 137/78.2
4,883,228 A 11/1989 Vydrzal
5,011,081 A 4/1991 Bentley
5,133,501 A 7/1992 Marshall
6,050,500 A 4/2000 Ensworth
6,135,362 A 10/2000 Purdy
6,234,411 B1 5/2001 Walker et al.
6,491,235 B1 12/2002 Scott
6,568,608 B2 5/2003 Sirkin
6,808,127 B2 10/2004 McNulty
6,874,696 B1 4/2005 Ericksen et al.
7,121,478 B1 10/2006 Jones

* cited by examiner

*Primary Examiner*—Christopher S Kim
(74) *Attorney, Agent, or Firm*—Dykas & Shaver, LLP; Elizabeth Herbst Schierman

(57) ABSTRACT

The invention is riser assembly for use with a fluid dispenser particularly a sprinkler. The assembly includes: (1) a container partially circumscribing a reservoir for containing a pressurized fluid, the container having a fluid inlet and a fluid outlet disposed therethrough, and (2) a conduit circumscribing a channel occupiable by a signal carrier, the conduit including an intermediate conduit portion disposed within the reservoir, a first conduit portion disposed through the container to a signal carrier entry area outside the container and a second conduit portion disposed through the container to a signal carrier exit area outside the container. The assembly may include a cover connectable to the container, the cover having an aperture for containing the fluid dispenser disposed therethrough, a protective cavity being formed between the cover and the container.

16 Claims, 12 Drawing Sheets

RISER ASSEMBLY FOR USE WITH FLUID SPRINKLER

TECHNICAL FIELD

The invention relates to a riser assembly for use with a fluid dispenser. More specifically, the invention relates to an adjustably weighted riser assembly for use with a fluid dispensing sprinkler, the riser assembly including a reservoir for containing a pressurized fluid and a conduit circumscribed channel occupiable by a signal carrier, the conduit having a fluid excluding intermediate portion disposed within the reservoir.

SUMMARY OF THE INVENTION

Processes for conveying fluid from a pressurized fluid source through a fluid dispensing sprinkler are known. In a typical practice, fluid pressurized by a pump is conveyed from a supply pipe through a riser assembly and expelled through a sprinkler. Various means for controlling expulsion of fluid through a sprinkler have been utilized. These means for controlling fluid expulsion include associating a control valve with the sprinkler, associating a control valve with the riser assembly or associating a control valve with an intermediate connector between the riser assembly and the sprinkler. A wire or other signal carrier may convey a signal to a signal processor which then processes the signal and influences movement of the control valve to control fluid expelled.

The installation, maintenance, removal and transport of a riser assembly can present a number of challenges. Particularly in the case of riser assemblies used with high output directional sprinklers, a first set of challenges arises from the fact that expulsion of fluid through the sprinkler can exert significant and potentially destabilizing forces upon the riser assembly. This challenge is compounded where such forces may be exerted from varying angular, or lateral directions as, for example, in the case of a riser assembly used with a powerful rotary sprinkler.

Another set of challenges arises from temperature variations, precipitation and other environmental conditions encountered in the often rugged outdoor settings where a riser assembly is used. These environmental conditions can pose a challenge not only to the riser assembly itself but additionally to functional elements operatively connectable with the riser assembly and, particularly, to wires and other signal carriers, signal processors and control valves.

Past approaches to address the foregoing challenges have been proposed. One such approach involves the burial of all or most of the riser assembly in soil or other ground material. In addition to burial of the riser assembly in the ground, approaches for stabilizing a riser assembly include encasement of the riser assembly within a concrete pier or the attachment of the riser assembly to materials that either are not removable or are not easily removable without damaging the riser assembly. Such attempts to stabilize riser assemblies have typically resulted in assemblies that are: (1) complicated, difficult, expensive and time consuming to install and maintain, and (2) complicated, difficult, expensive or even impossible to remove, transport and reinstall.

There accordingly exists a need for a riser assembly useable even with high output directional sprinklers that facilitates rapid, efficient, yet sturdy and easily modifiable connection of the riser assembly to a pressurized fluid source and that does not require a concrete pier or even burial of a majority of the riser assembly in the ground. A need also exists for an adjustably weighted riser assembly that accomplishes the foregoing purposes and can be easily and efficiently installed, maintained, removed and reinstalled with minimal use of tools and without damage to the riser assembly and any associated signal carrier, signal processor or means for controlling expulsion of fluid through the sprinkler. The assembly of the present invention addresses these needs.

The riser assembly of the present invention also provides a reservoir for containing a pressurized fluid and a conduit circumscribing a channel occupiable by a signal carrier, the conduit having a fluid excluding intermediate portion disposed within the reservoir. The riser assembly thus allows for disposal of a signal carrier through a fluid excluding and insulated channel to carry a signal from outside the container through the channel to a signal processor, the signal processor being operatively connectable to means for selectively controlling expulsion of fluid through the sprinkler in response to a signal received by the signal processor through the signal carrier. The channel is accordingly insulated from elements outside the container not only by the conduit and container but also by the pressurized fluid within the reservoir. Because the riser assembly of the present invention contains a reservoir for containing pressurized fluid, it is rendered comparatively heavier and more stable during times of use when the reservoir is filled with fluid and comparatively lighter during the assembly's installation, removal and transport when the reservoir is devoid of fluid.

Among other uses, the assembly of the present invention has particular utility in the livestock feeding context where many animals are enclosed in close proximity for feeding prior to their sale at market. Feedlot irrigation systems often include a main water supply line connected to a system of subterranean supply lines and a plurality of risers, each riser being connectable to the water supply line. A sprinkler head operatively connects to the riser to dispense water over a desired area. Advantages of feedlot irrigation include minimization of airborne dust which can produce nose, respiratory, skin and eye problems. Feed lot irrigation also facilitates bacterial and disease control and can assist in reducing the mortality rate and damage to livestock prior to sale. Feed lot irrigation moderates ground temperature and thereby reduces stress upon livestock.

SUMMARY OF THE INVENTION

It is an object of this invention to provide a riser assembly for use with a fluid dispenser, particularly a sprinkler. In a preferred embodiment, the riser assembly includes: (1) a container partially circumscribing a reservoir for containing a pressurized fluid, the container having a fluid inlet and a fluid outlet disposed therethrough, (2) a cover connectable to the container, the cover having an aperture for containing a sprinkler supply line disposed therethrough, a cavity being formed between the cover and the container and (3) a conduit circumscribing a channel occupiable by a signal carrier, the conduit having a fluid excluding intermediate portion disposed within the reservoir, a first conduit portion disposed through the container to a signal carrier entry area outside the container and a second conduit portion disposed through the container to a signal carrier exit area.

It is a further object of this invention to provide for use with a fluid dispenser a riser assembly that facilitates rapid, efficient, sturdy and easily modifiable connection of the riser assembly to a pressurized fluid source and the stable use thereof without need of a concrete pier, permanent anchor or the burial of a majority of the riser assembly in the ground.

It is a further object of this invention to provide a riser assembly that is adjustably weighted so as to be (1) heavier and more stable during operation and the expulsion of fluid from the assembly through an operatively connected fluid dispenser and (2) lighter during installation, removal and transport of the riser assembly.

It is a further object of this invention to provide an insulated channel for containing a signal carrier that is insulated not only by a conduit contained within a container but also by a reservoir fillable with pressurized fluid.

It is a further object of this invention to provide for use with a fluid dispenser that is a high output directional sprinkler a riser assembly that accomplishes the foregoing purposes and can be easily and efficiently installed, maintained, removed and reinstalled, with minimal use of additional tools and without damage to the riser assembly or an associated signal carrier, associated signal processor or associated means for controlling expulsion of fluid through the sprinkler.

Another object of the invention is to provide an assembly with the stability, ease and simplicity of an invention having a minimal number of component parts.

Another object of this invention is to provide an assembly in accordance with the preceding objects which will conform to conventional forms of manufacture, be of comparatively simple construction and easy to use so as to provide an invention that will be economically feasible, durable and relatively free of trouble in use and operation.

These together with the other objects and advantages of the invention which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
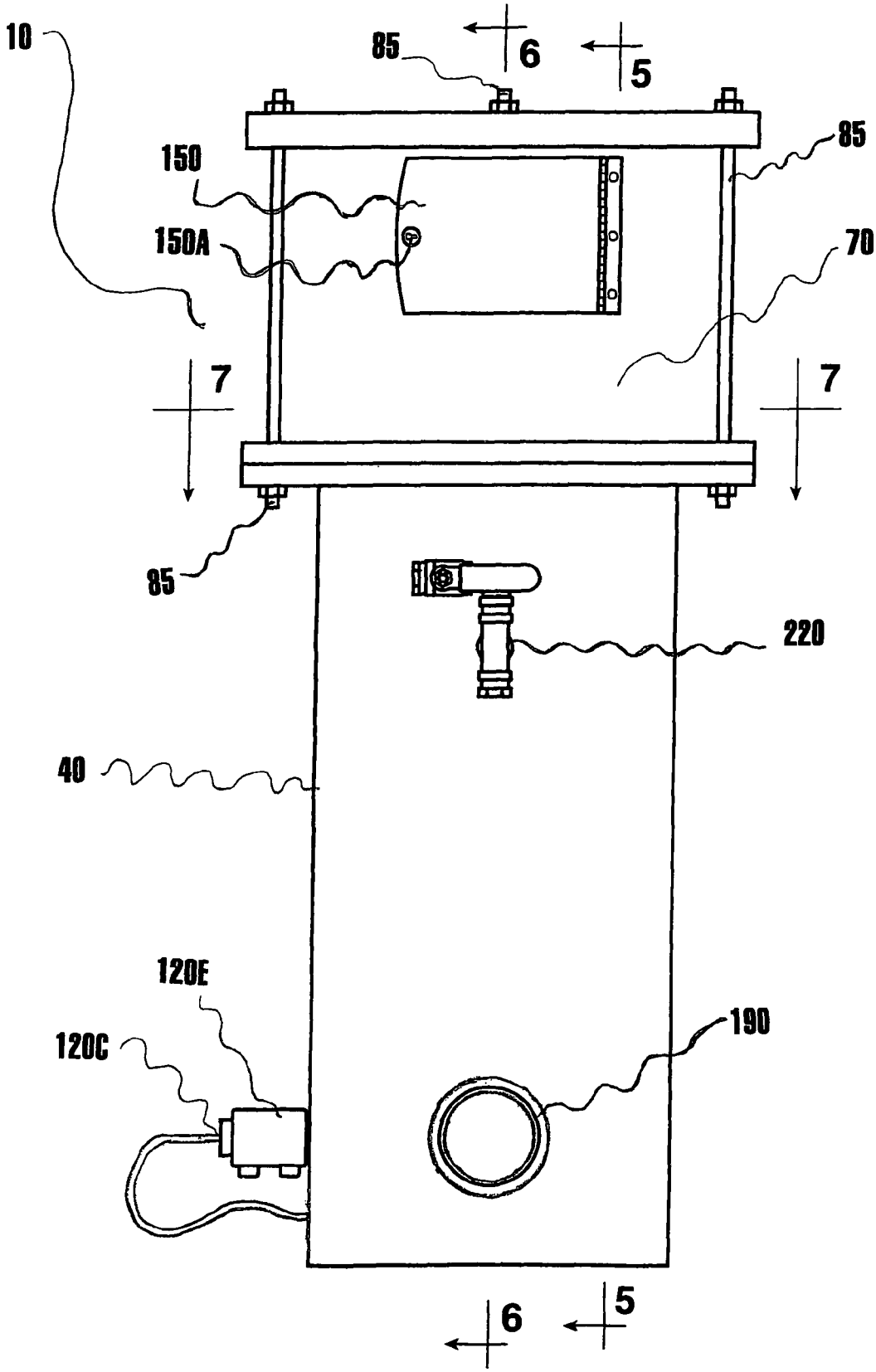
FIG. 1 is an elevated front plan view of an embodiment of the riser assembly of the present invention.
Figure 2:
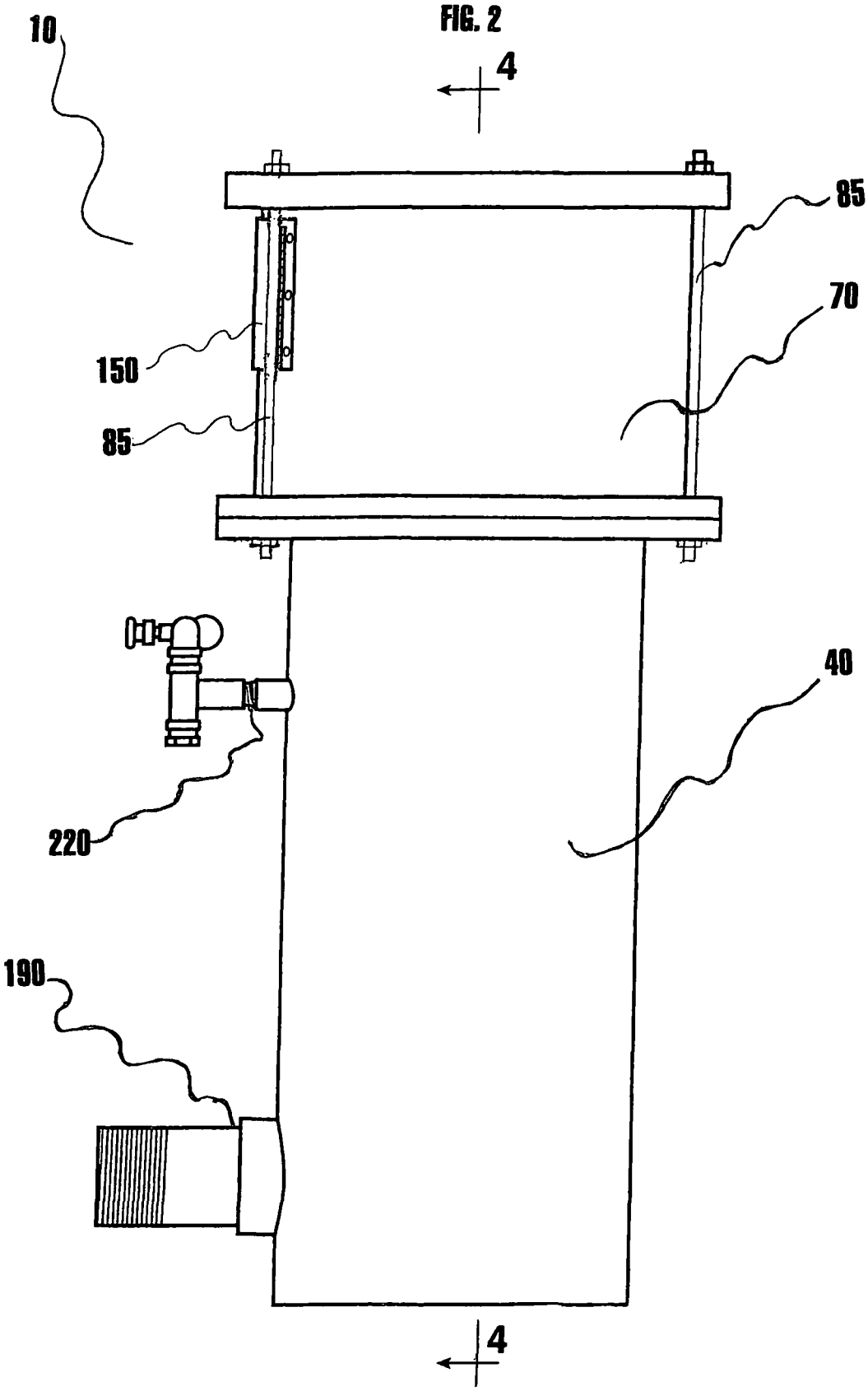
FIG. 2 is a first elevated side plan view of an embodiment of the riser assembly of the present invention.
Figure 3:
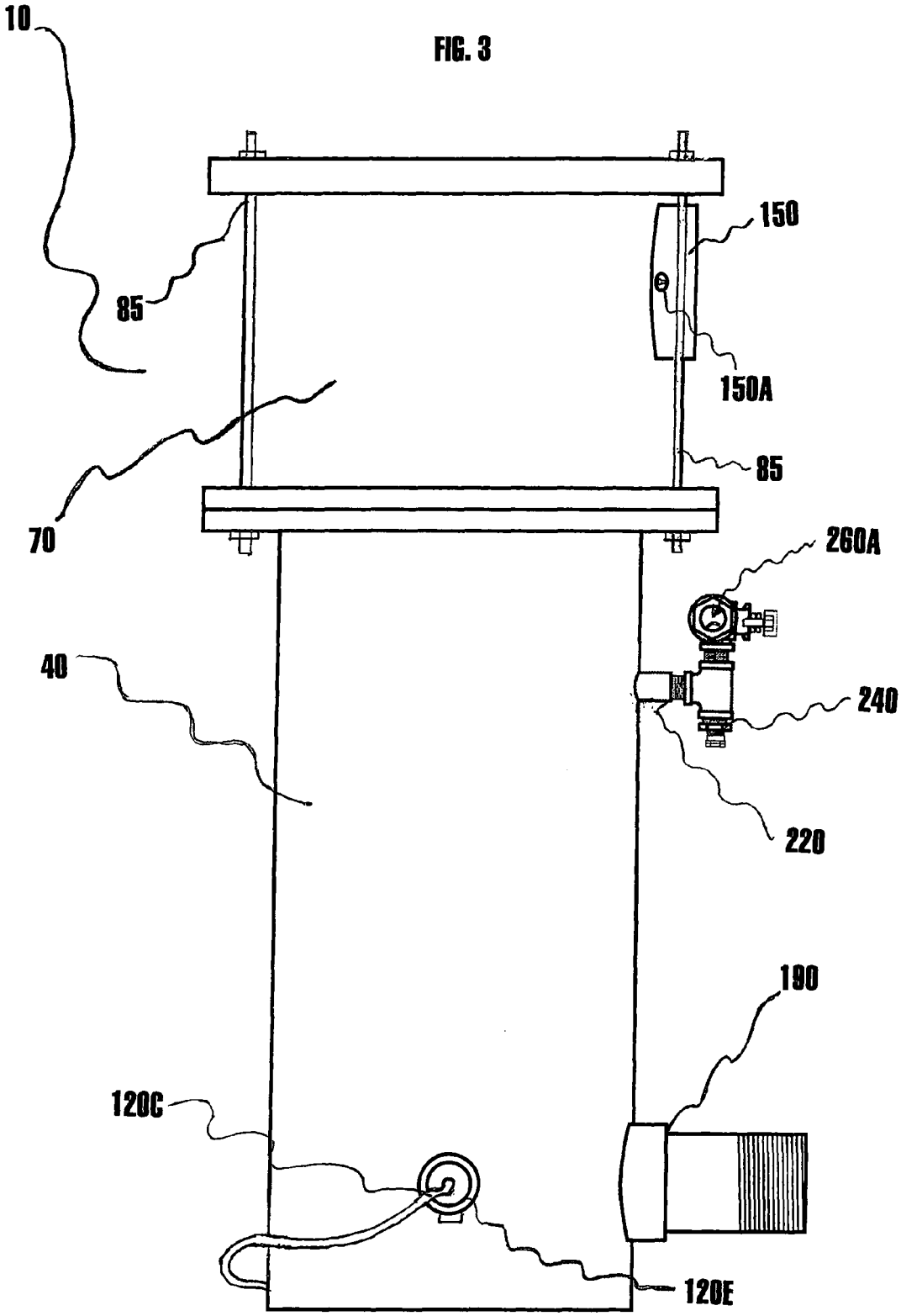
FIG. 3 is a second elevated side plan view of an embodiment of the riser assembly of the present invention.
Figure 8:
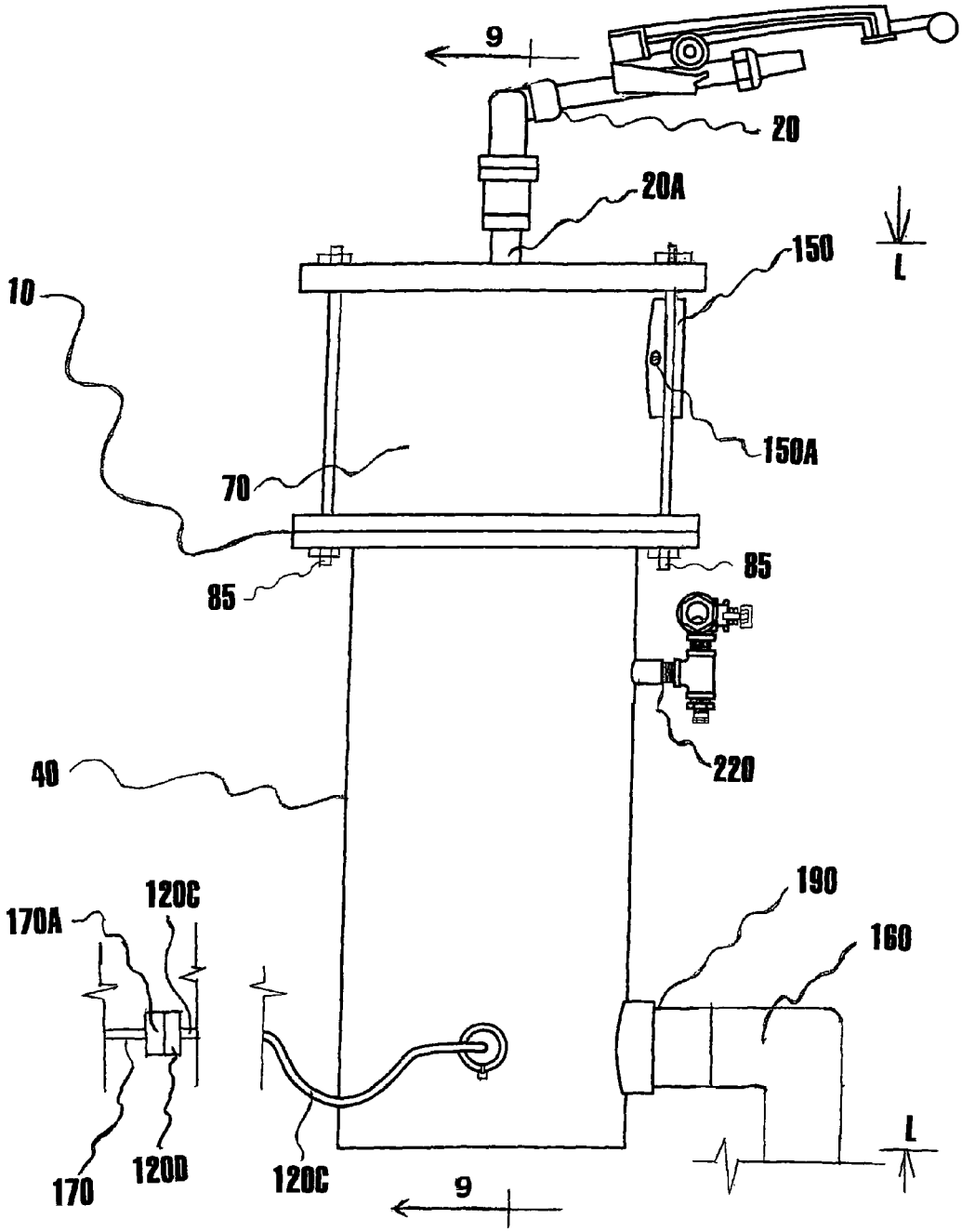
FIG. 8 is an elevated side plan view of an embodiment of the riser assembly of the present invention shown in operative connection with a fluid dispenser, the fluid dispenser being a sprinkler with associated means for selectively controlling expulsion of fluid through the sprinkler.

FIGS. 1 through 3 illustrate a preferred embodiment of a riser assembly 10. The riser assembly 10 is designed for use with a fluid dispenser, the fluid dispenser being preferably a sprinkler illustrated generally as item 20 in FIG. 8 and, particularly, a sprinkler for spraying pressurized fluids with an associated control valve 30 (FIG. 9) for selectively controlling fluid expelled through the sprinkler 20.

With attention directed principally to FIGS. 1 through 7, it is seen that a preferred embodiment of the riser assembly 10 includes: (1) a container 40 having a side wall 40A, a top 40B and a bottom 40C, the container 40 partially circumscribing a reservoir 50 (FIGS. 4, 5, 6 and 9) for containing a pressurized fluid 60, the container 40 having a fluid inlet 40D and a fluid outlet 40E (FIG. 6) disposed therethrough; (2) a cover 70 connectable by a plurality of fasteners 85 to the top 40B of the container 40, the cover 70 having an aperture 80 (FIG. 6) for containing a sprinkler supply line 20A (FIGS. 8 and 9) disposed therethrough, a cavity 90 (FIGS. 4, 5, 6 and 9) being preferably formed between the cover 70 and the container 40; and (3) a conduit 100 (FIGS. 4, 5, 6 and 9) circumscribing a channel 110 (FIGS. 6 and 7) occupiable by a signal carrier 120 (FIGS. 6 and 7), the signal carrier 120 being most preferably a plurality of wires or a cable for conveying an electronic signal. An intermediate conduit portion 100A of the conduit 100 is disposed within the reservoir 50 and is constructed to exclude fluid 60 within the reservoir 50 from the channel 110.

With attention directed primarily to FIGS. 4, 5, 6 and 9 it is further seen that in a preferred embodiment of the riser assembly 10: (1) A first conduit portion 100B operatively connects to the intermediate conduit portion 100A and is disposed through the container 40 to a signal carrier entry area 120A outside the container 40; (2) a second conduit portion 100C operatively connects to the intermediate conduit portion 100A and is disposed through the container 40 to a signal carrier exit area 120B outside the container 40 and, preferably, within the cavity 90; and (3) the signal carrier 120 (FIGS. 6 and 7) may accordingly be disposed through the channel 110 (FIG. 6) circumscribed by the conduit 100 to carry a signal from outside the container 40 through the channel 110 to a signal processor 130 (FIG. 9) situatable within the cavity 90, the signal processor 130 being operatively connectable to means for selectively controlling expulsion of fluid 60 through the sprinkler 20 in response to a signal received through the signal carrier 120. The means for selectively controlling expulsion of fluid 60 through the sprinkler 20 preferably include a control valve 30 operatively connected to the sprinkler 20. In a preferred configuration the control valve 30 is operatively connectable to a solenoid 30A and a pressure regulator 30B. In a preferred configuration a second signal carrier coupler 120F (FIG. 9) is detachably connected to the remainder of the signal carrier 120 and adapted for connection to the signal processor 130.

An embodiment of the riser assembly 10 is adapted for use with, and operative connection to: (1) a control valve 30, an example of which is identified as a "pilot operated valve" as disclosed in U.S. Pat. No. 3,439,895, the patent and items disclosed therein being incorporated herein by this reference, and (2) a sprinkler, an example of which is identified as the "sprinkler head" disclosed in U.S. Pat. No. 4,669,663 and U.S. Pat. No. 4,193,543, the patents and items disclosed therein being incorporated herein by this reference. It is to be appreciated though that embodiments of the riser assembly 10 may be configured for use with alternate sprinklers, control valves and signal processors that function to selectively control expulsion of pressurized fluid 60 from the reservoir 50 of the present invention through an operatively attachable sprinkler 20 in response to a signal carried by a signal carrier 120. It is further to be appreciated that the assembly 10 may be configured to allow for operative connection to a fluid pressure regulator 30B (FIG. 9) allowing a human operator to monitor fluid pressure.

In a preferred embodiment, the container 40 and the conduit 100 are (1) composed of electrically resistant, high density polyethylene capable of withstanding at least 200 pounds of pressure per square inch and connections between (1) the top 40B, the side wall 40A and the bottom 40C and (2) the container 40 and conduit 100 are formed by electro-fusion treatment to create a fluid tight seal for containing a fluid 60 pressurized at up to 200 pounds per square inch. Alternatively, the container 40 can be formed by injection molding to provide an integral piece of high density polyethylene capable of withstanding at least 200 pounds of fluid pressure per square inch.

With further attention directed principally to FIGS. 1 through 7, it is seen that in a preferred embodiment of the riser assembly 10 the cover 70: (1) connects by a plurality of fasteners 85 to the top 40B of the container 40, (2) has an aperture 80 (FIG. 6) for containing a sprinkler supply line 20A (FIG. 9) disposed therethrough, (3) facilitates formation of a protective cavity 90 between the cover 70 and the top 40B of the container 40, and (4) may have disposed therethrough an opening 140 (FIG. 4) coverable by a door 150 with a lock 150A selectively openable by a human operator to facilitate such operator's selective access to the cavity 90 and items contained therein. In a preferred embodiment, the lock 150A selectively secures the door 150 to the cover 70.

With attention directed primarily to FIGS. 4, 5, 6 and 9 it is further seen that in a preferred embodiment: (1) A first conduit portion 100B operatively connects to the intermediate conduit portion 100A and is disposed through the container 40 to a signal carrier entry area 120A outside the container 40; (2) a second conduit portion 100C is operatively connected to the intermediate conduit portion 100A and is disposed through the container 40 to a signal carrier exit area 120B outside the container 40 and, preferably, within the cavity 90; and (3) the signal carrier 120 may accordingly be disposed through the channel 110 (FIGS. 6 and 7) circumscribed by the conduit 100 to carry a signal, most preferably being an electronic signal (not shown), from outside the container 40 through the channel 110 to a signal processor 130 protected within the cavity 90, the signal processor 130 being operatively connected to means for selectively controlling expulsion of fluid 60 through the sprinkler 20 in response to a signal received through the signal carrier 120. In a preferred embodiment, the first conduit portion 100B is disposed through a first extrusion 40F (FIG. 4), the first extrusion 40F extending outwardly away from an outer surface 40G of the container 40 and the second conduit portion 100C is disposed through a second extrusion 40H (FIG. 4), the second extrusion 40H extending upwardly away from an upper surface 40I of the container 40.

With attention directed principally to FIGS. 4, 5, 6 and 9 it is seen that in a preferred embodiment of the assembly 10: (1) the fluid inlet 40D (FIG. 6) is disposed though a side wall 40A of the container 40, (2) the fluid outlet 40E (FIG. 6) is disposed though a top 40B of the container 40, (3) the fluid inlet 40D is proximate an end of a fluid intake passageway 180, the fluid intake passageway being contained by a fluid intake pipe 190, (4) the fluid outlet 40E is proximate an additional end of a fluid outlet passageway 200, the fluid outlet passageway being partially circumscribed by a fluid outlet pipe 210, and (5) a secondary fluid outlet 220A is disposed through the container 40. The secondary fluid outlet 220A is preferably disposed into a secondary fluid outlet subassembly 220 (FIGS. 1, 3 and 11), the secondary fluid outlet subassembly 220 preferably including: (1) means for selectively controlling flow of pressurized fluid from the reservoir 50 through the secondary fluid outlet 220A and through a pressurized fluid release hole 260A, a preferred means for selectively controlling flow of the pressurized fluid including a ball valve subassembly 230 disposed between the secondary fluid outlet 220A (FIG. 6) and the pressurized fluid release hole 260A (FIGS. 3 and 11), (2) a fluid drain valve 240 (FIGS. 3 and 11) and (3) a connection pipe 220C.

Figure 10:
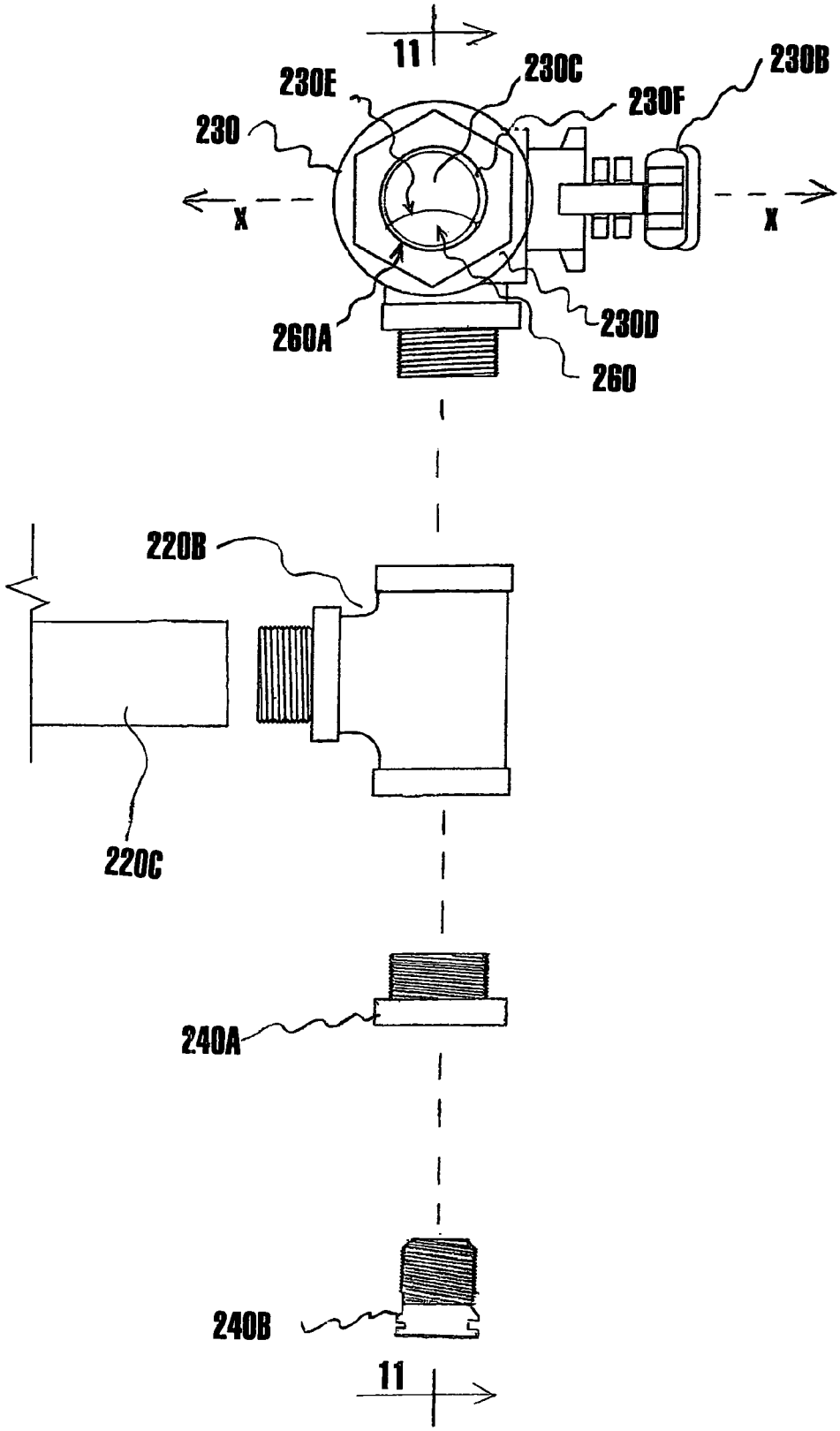
FIG. 10 is a partially exploded view of a secondary fluid outlet subassembly noted as item 220 in FIG. 3.

As principally seen in FIG. 10, the ball valve subassembly 230 preferably includes a lever 230B operatively connected to a ball 230C, the ball 230C being snugly encased within a gasket 230F in a housing 230D, the ball 230C having a ball aperture 230E disposed therethrough. In a preferred embodiment shown, the ball aperture 230E is selectively movable between (1) a closed position wherein the ball aperture 230E is perpendicular to a fluid expulsion channel 260 and (2) an open position wherein the ball aperture 230E is aligned to form part of the fluid expulsion channel 260 by an operator applying force to the lever 230B and thereby partially rotating the ball 230C within the housing 230D around an axis illustrated generally as X in FIG. 10. The ball valve subassembly 230 enables the operator to selectively open and close the fluid expulsion channel 260 by applying pressure to the lever 230B and to thereby selectively expel pressurized fluid 60 from the reservoir 50. In a preferred embodiment: a) an end of the ball valve subassembly 230 is threaded to allow for rapid detachable operative connection of the ball valve subassembly 230 to a correspondingly threaded branch member 220B; and b) the branch member 220B is further threaded to allow for the branch member's rapid detachable operative connection by rotational insertion to the container 40 proximate the secondary fluid outlet 220A. It is, however, to be appreciated that alternative means for attaching the secondary fluid outlet subassembly 220 to the container 40 at the secondary fluid outlet 220A may also be used.

Figure 6:
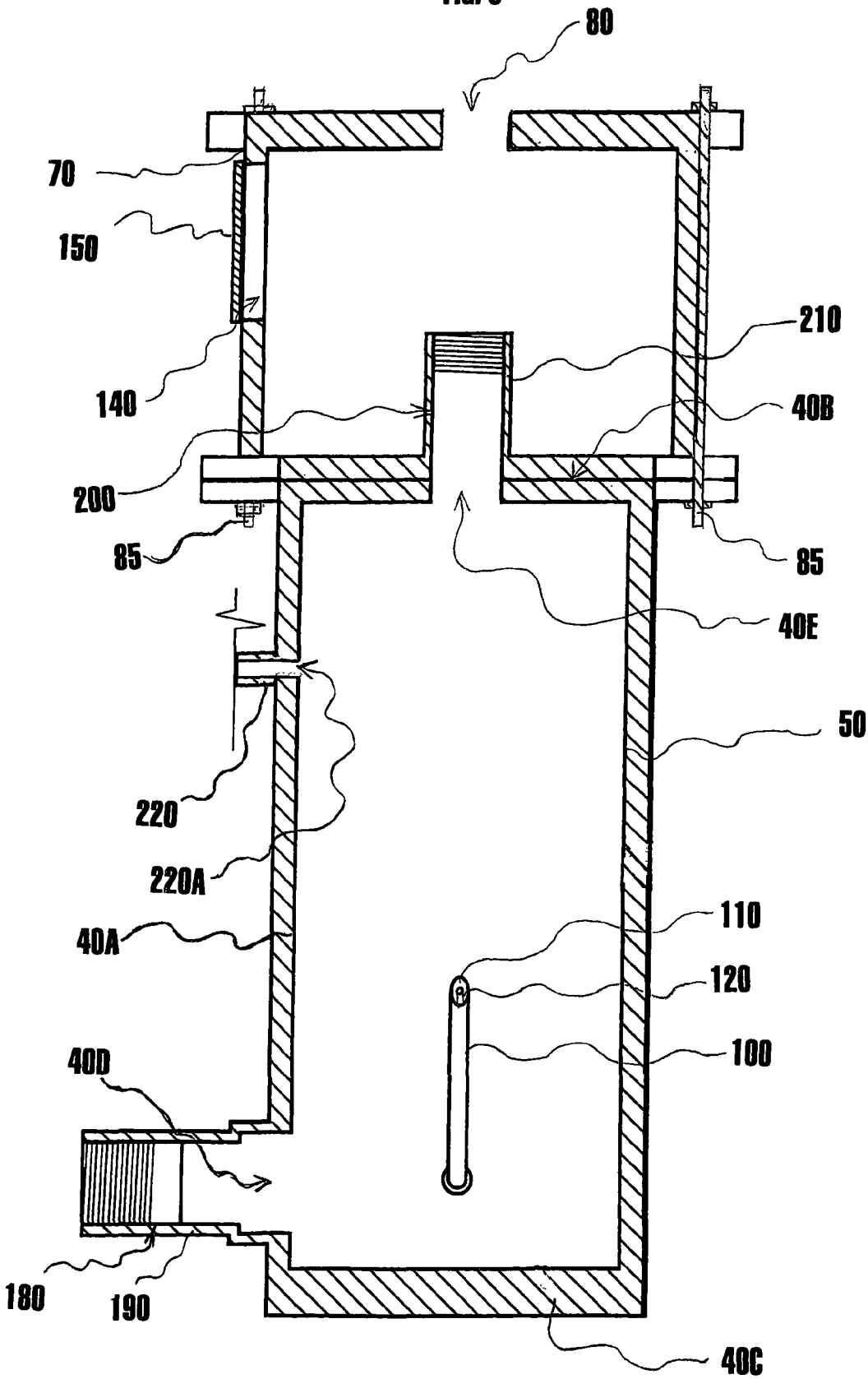
FIG. 6 is a partial sectional view taken through line 6-6 of FIG. 1.
Figure 11:
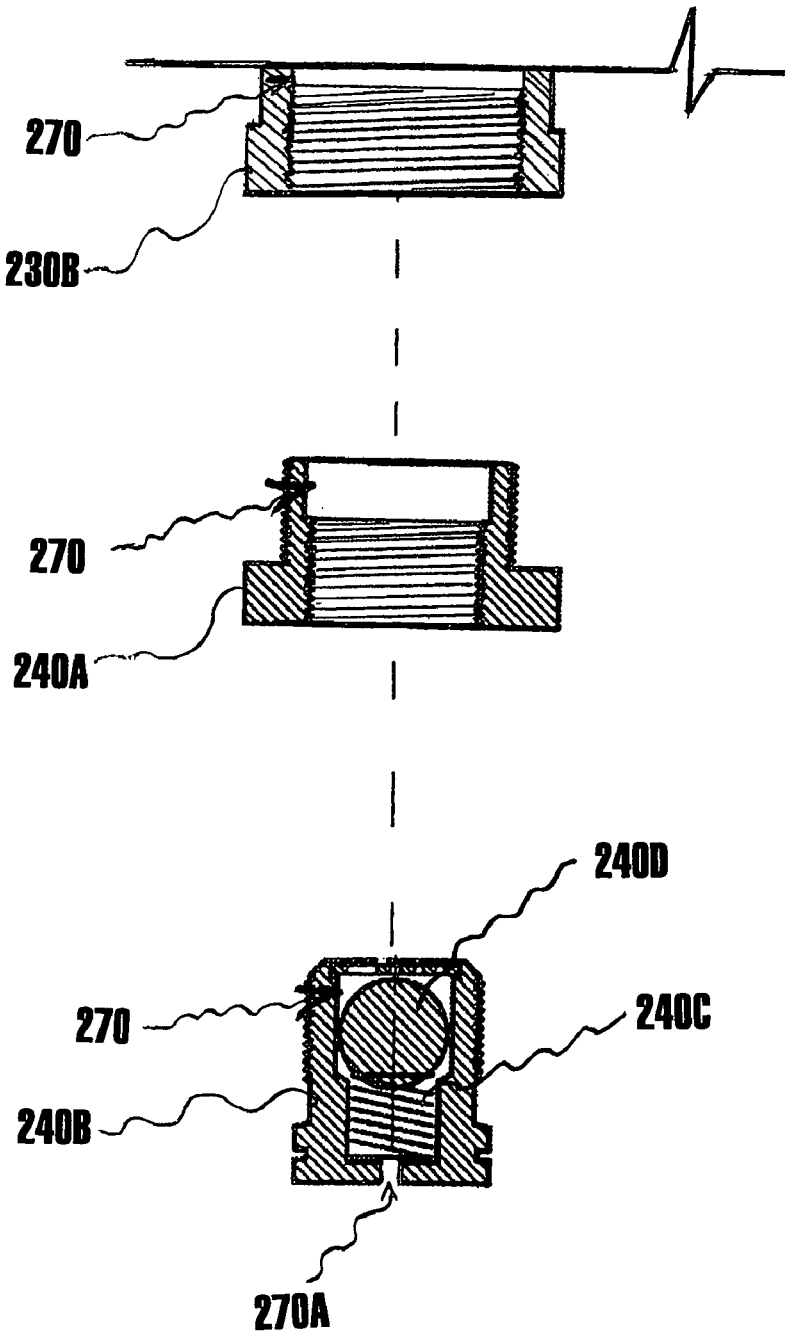
FIG. 11 is a partial sectional view of the secondary fluid outlet subassembly taken through line 11-11 of FIG. 10.

As principally seen in FIGS. 6, 10 and 11, the secondary fluid outlet subassembly 220 preferably also includes a fluid drain valve 240 functioning to allow automatic draining of fluid 60 from the reservoir 50 through a drain hole 270A after use of the riser assembly 10 when the fluid 60 within the reservoir 50 is no longer pressurized. The fluid drain valve 240 preferably includes: (1) a first threaded insert member 240A rotatably insertable into the branch member 220B, the first threaded insert member 240A having a first portion of a fluid drain passageway 270 disposed therethrough; (2) a second threaded insert member 240B rotatably insertable into the first threaded member 240A and having a second portion of the fluid drain passageway 270 disposed therethrough, the second insert member 240B circumscribing a second portion of the fluid drain passageway 270, the fluid drain passageway 270 being continuously disposed from the secondary fluid outlet 220A through the container 40 to the drain hole 270A; and (3) a spring 240C with a stopper 240D operatively connected thereto, the spring 240C holding the stopper within the second insert member 240B in a spaced relationship to the drain hole 270A such that (a) as pressurized fluid moves through the fluid drain passageway 270 toward the drain hole 270A, the stopper 240D is forced toward the drain hole 270A and connects the second insert member 240B closing the fluid drain passageway 270 and (b) as pressure is removed from fluid within the fluid drain passageway 270, the stopper 240D is forced by the spring 240C away from the drain hole 270A thereby opening the fluid drain passageway 270 and allowing fluid 60 to exit from the container 40 through the fluid drain passageway 270 and out of the drain hole 270A.

Figure 4:
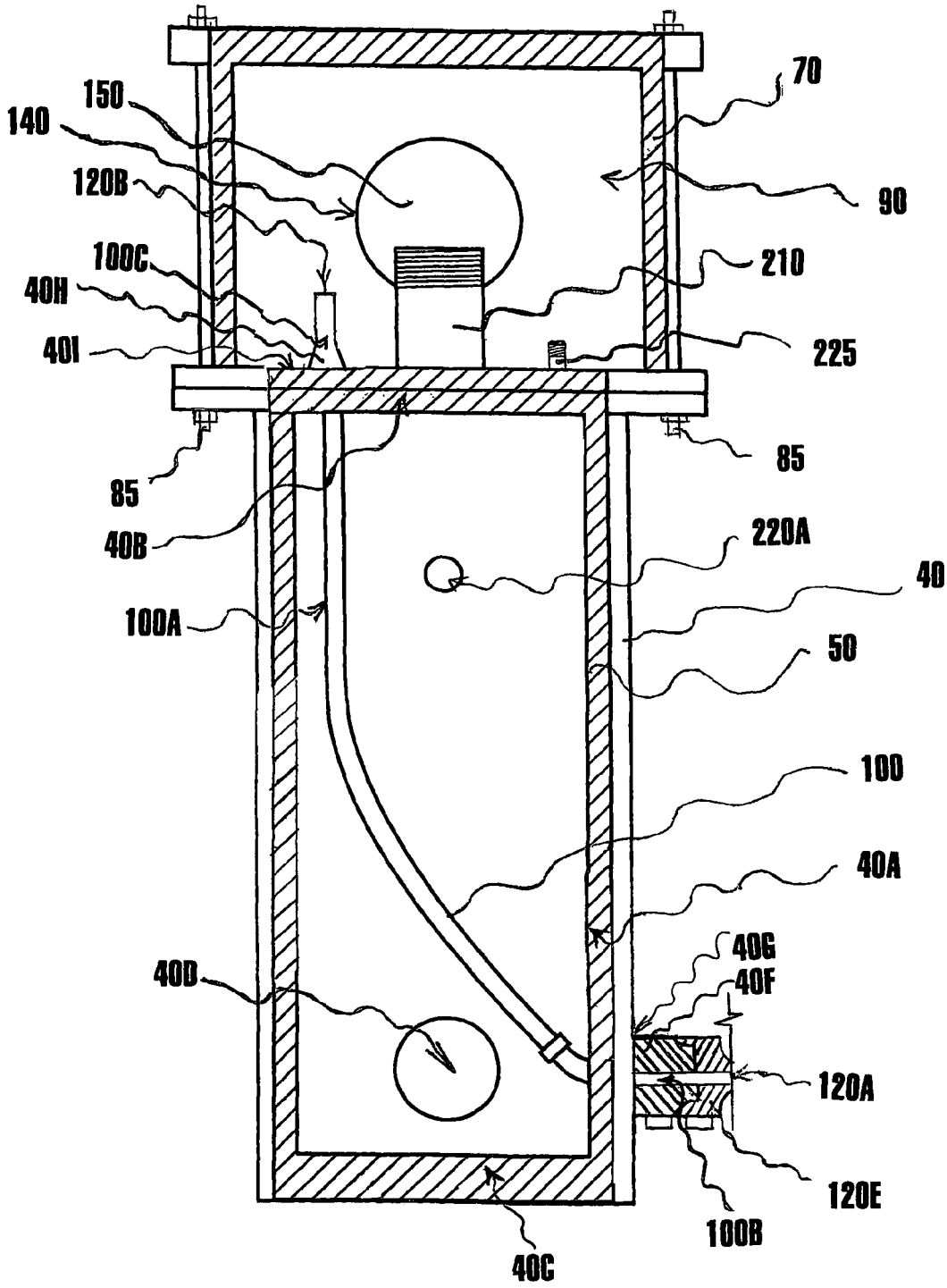
FIG. 4 is a partial sectional view taken through line 4-4 of FIG. 2.
Figure 5:
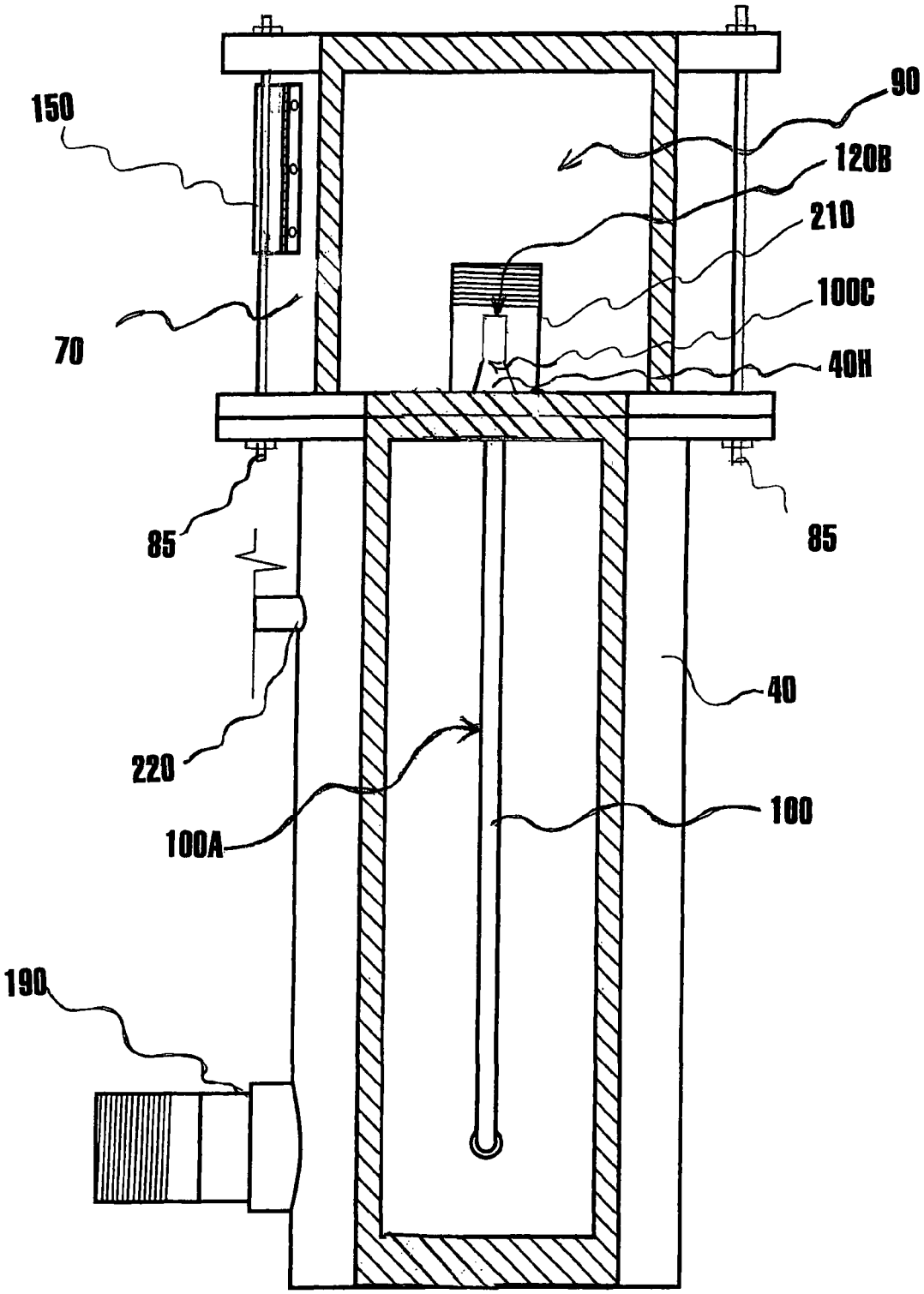
FIG. 5 is a partial sectional view taken through line 5-5 of FIG. 1.
Figure 7:
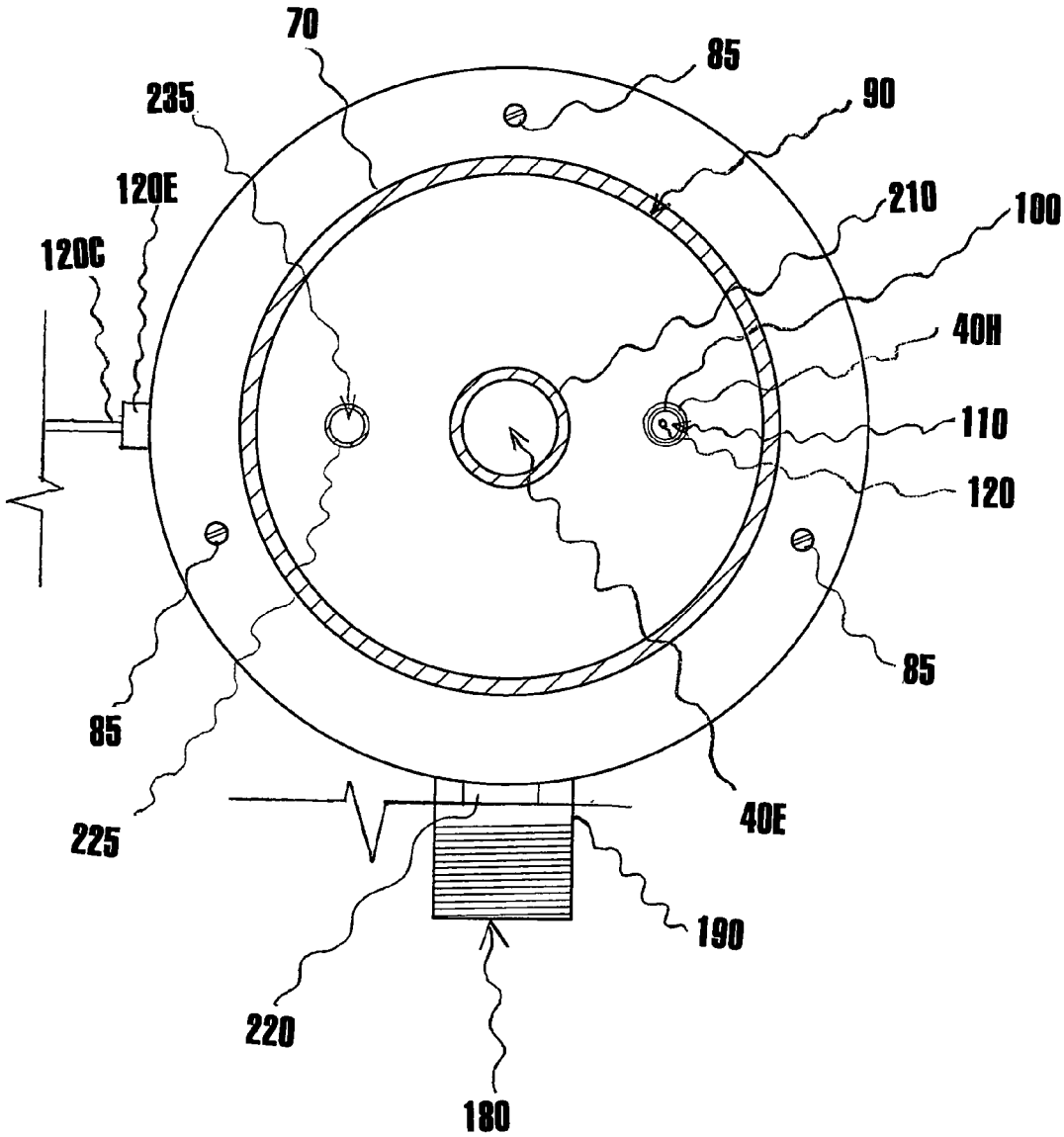
FIG. 7 is a partial sectional view taken through line 7-7 of FIG. 1.
Figure 9:
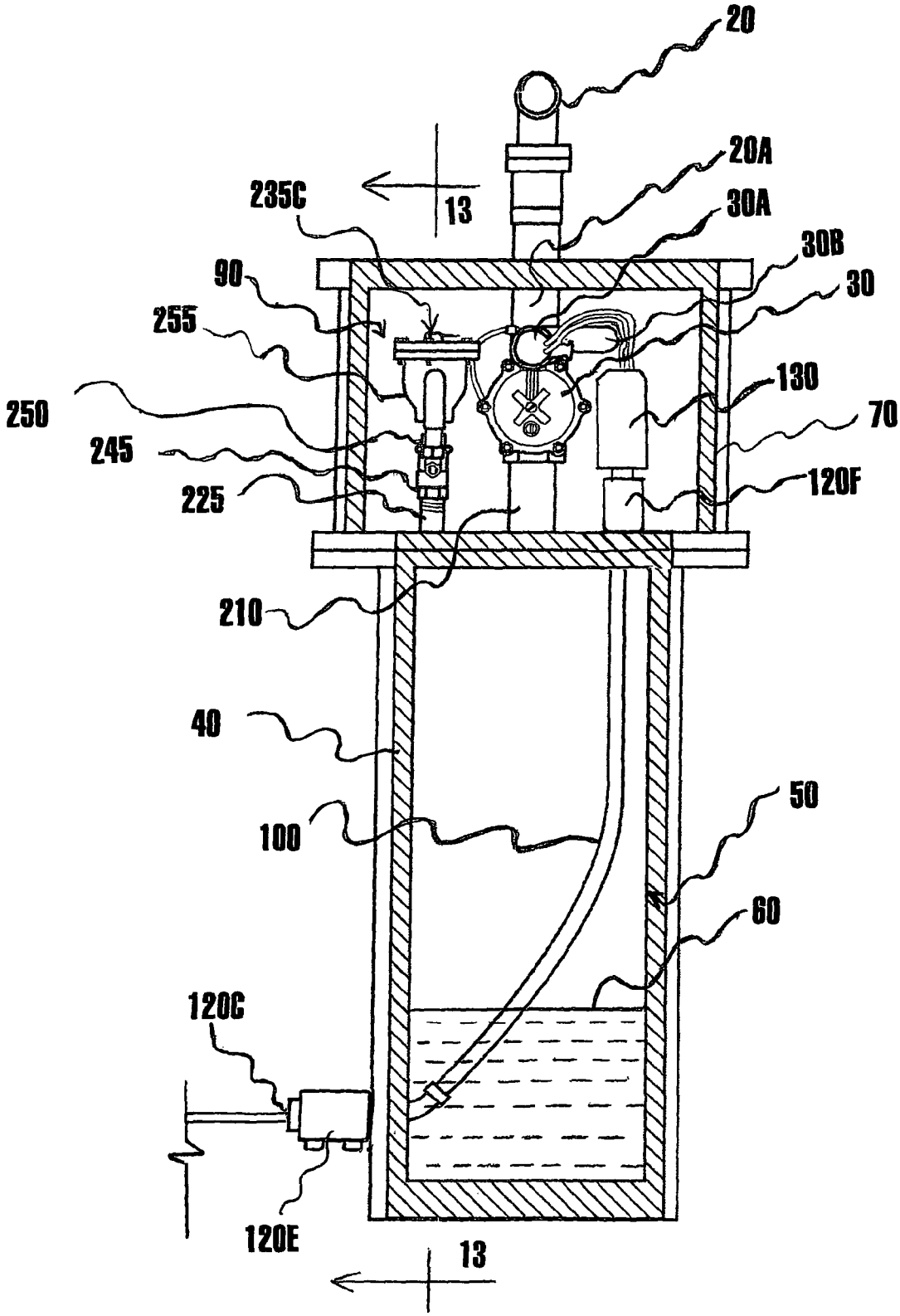
FIG. 9 is a sectional view taken through line 9-9 of FIG. 8 shown with a reservoir of the riser assembly being partially filled with fluid.

With attention directed principally to FIGS. 4, 7 and 9 it is seen that the riser assembly 10 preferably includes an air pipe 225 having an air passageway 235 disposed therethrough, the air passageway 235 being disposed through the container 40. The air pipe 225 functions to: (1) release air from the reservoir 50 through the air passageway 235 when fluid 60 is initially introduced under pressure into the reservoir 50 displacing air initially contained within the reservoir 50 and (2) allow air to re-enter the reservoir 50 when fluid 60 is drained from the riser assembly 10 after use. In a preferred embodiment shown, the air pipe 225 is adapted for rapid, stable operative connection to means for selectively controlling release of air through the air pipe 225, a preferred such means for controlling release of air preferably including an air release valve subassembly 250 having (1) a second ball valve subassembly 245 (FIG. 12) and (2) an air drain valve subassembly 255 (FIG. 13).

Figure 12:
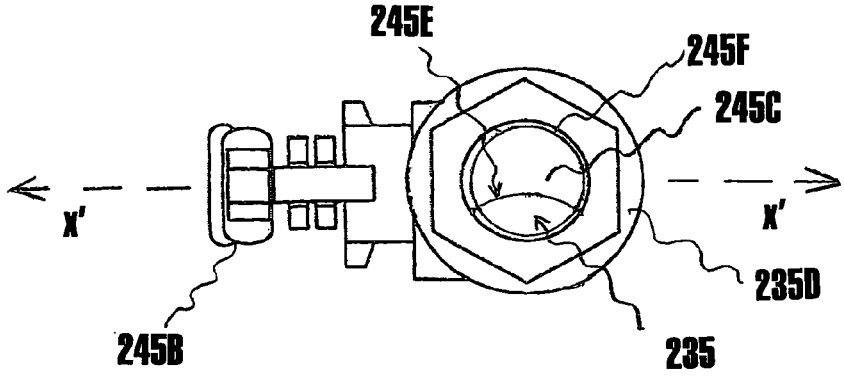
FIG. 12 is a bottom plan view of a second ball valve subassembly noted as item 245 in FIG. 9.

Referring principally to FIG. 12, the second ball valve subassembly 245 preferably includes a second lever 245B operatively connected to a second ball 245C, the second ball 245C being snugly encased within a second gasket 245F in a second housing 245D and having a second ball aperture 245E disposed therethrough. The second ball aperture 245E is selectively movable between (1) a closed position wherein the second ball aperture 245E is perpendicular to the air passageway 235 and (2) an open position wherein the second ball aperture 245E is aligned to form a part of the air passageway 235 by an operator applying force to a second lever 245B and thereby partially rotating the second ball 245C within the second housing 245D around an axis illustrated generally as X' in FIG. 12.

Figure 13:
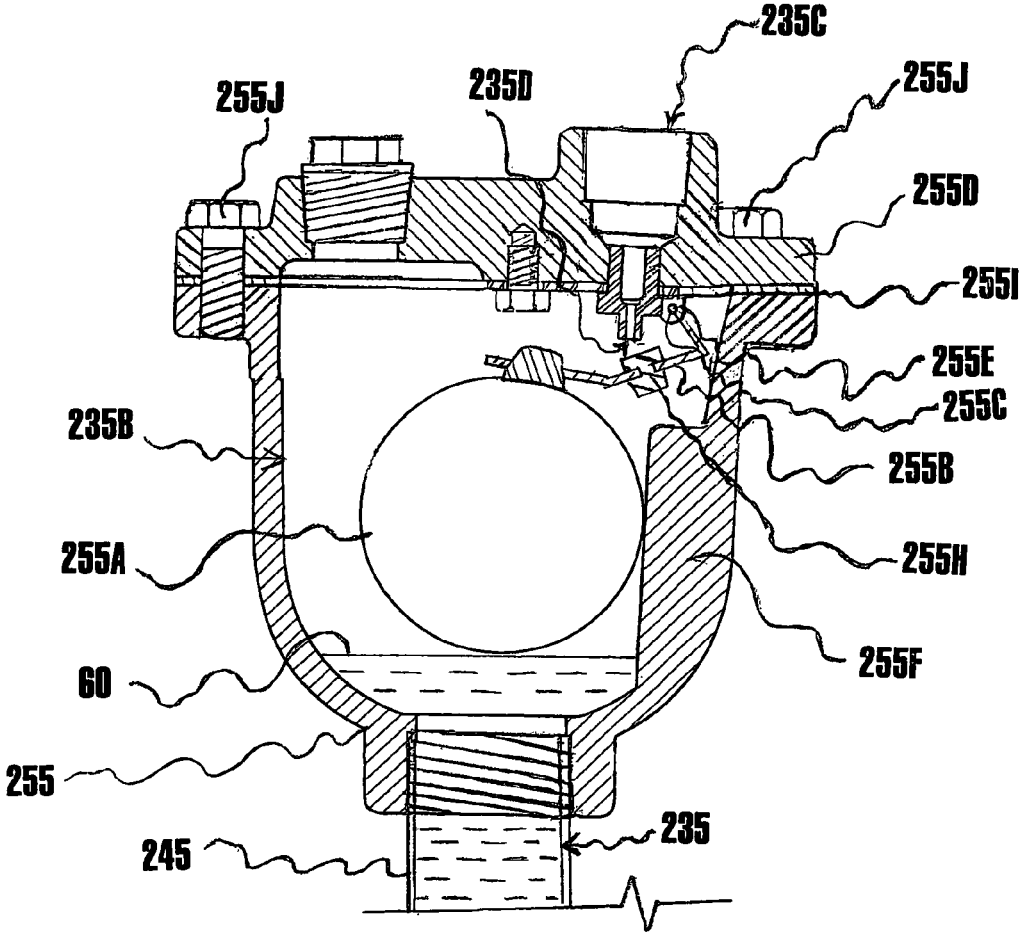
FIG. 13 is a sectional view of item 255 and an upper portion of item 245 taken through line 13-13 of FIG. 9.

Referring principally to FIG. 13, air drain valve subassembly 255 preferably includes a float 255A pivotally connected by a float arm 255B to a float pivot pin 255C, the float pivot pin being operatively connected to the air drain valve cover 255D by a bracket 255E. The float 255A is disposed within an air passage corridor 235B circumscribed by a drain valve body 255F and an air drain valve cover 255D, the air drain valve cover 255D having an air drain hole 235C disposed therethrough and being operatively connected to a connection gasket 255I and to the drain valve body 255F by drain valve body fasteners 255J. In standard operation, displaced air travels from the reservoir 50 through the air passageway 235 and the air passage corridor 235B when fluid 60 is initially introduced under pressure into the reservoir 50. When the fluid 60 reaches the float 255A, the float 255A floats upwardly around the float's pivotal connection with the pivot float pin 255C. As the float 255A floats upwardly, a float stop 255H preferably attached to the float arm 255B is moved upwardly to cover an orifice 235D at an end of the air drain hole 235C and thus prevents expulsion of pressurized liquid through the air drain hole 235C. After use of the assembly 10, pressure is withdrawn from the fluid 60 and fluid 60 within the air passage corridor 235B recedes causing the float 255A and pivot float pin 255C to move downward and thereby unstop the orifice 235D and allow air to reenter the air passage corridor 235B through the orifice 235D.

Although the air pipe 225 is adapted for rapid, stable operative connection to means for controlling release of air through the air pipe 225 and a preferred such means for controlling release of air includes an air release valve subassembly 250 having (1) a second ball valve subassembly 245 having and (2) an air drain valve subassembly 255, it is to be appreciated that the air pipe may alternatively be adapted for connection to alternative structures that function to control release of air from the reservoir 50 through the air passageway 235 and to automatically close such passageway 235 to prevent escape of fluid 60 when such air passageway 235 fills with pressurized fluid 60.

In standard operation, the riser assembly 10 functions to provide a pressurized fluid reservoir 50 and a stable, sturdy yet adjustably weighted support base for a selectively controlled fluid dispenser—the dispenser being preferably a directional sprinkler 20 operatively connected to a signal processor 130 and a control valve 30—in a single, connected configuration that is rapidly, conveniently, efficiently and detachably connectable to (1) a pressurized fluid source 160, the fluid source being preferably a subterranean pipe attached to a pump, and (2) a signal source 170, the signal source being most preferably a signal carrying wire, cable, or other relay operatively connected to a signal sender. In a preferred embodiment, the configuration of the riser assembly 10 and the reservoir 50 and the weight of the pressurized fluid 60 within the reservoir 50 facilitate stable operation of a rotary sprinkler 20 dispensing fluid pressurized at up to 200 pounds per square inch without need for extensive excavation, concrete thrust blocks or other permanent anchors by simply placing the riser assembly 10 in a comparatively shallow hole in the ground, the shallow hole being preferably less than one half the depth of the greatest longitudinal dimension L (FIG. 8) of the riser assembly 10 and using sand, soil and other natural fill material located proximate the shallow hole as backfill after the riser assembly 10 is placed in the hole.

The structure of a preferred embodiment of the riser assembly 10 also functions to allow for disposition of a signal carrier 120 from outside the container 40 through the channel 110 circumscribed by the conduit 100 to carry a signal through the channel 110 to a signal processor 130 situated within the cavity 90, the signal processor 130 being operatively connected to means for selectively controlling expulsion of fluid 60 through the sprinkler 20 in response to a signal received through the signal carrier 120. The channel 110 is accordingly insulated and protected not only by the conduit 100 and container 40 but also during standard operation of the riser assembly 10 by the pressurized fluid 60 within the reservoir 50. Moreover, the signal carrier 120 in a preferred embodiment is operatively connectable through a detachable cord 120C to a connection plug 120D (FIG. 8) and may thus be easily, rapidly, efficiently and detachably connected to a corresponding signal source outlet 170A for receiving a signal from a signal source 170 without need of additional tools. In a preferred embodiment, the cord 120C may be detachably connected to a remainder of the signal carrier 120 through a first detachable signal carrier coupler 120E.

The structure of a preferred embodiment of the riser assembly 10 further functions to facilitate alignment, configuration, protection and support of a signal processor 130, a sprinkler 20, a control valve 30 for selectively controlling expulsion of pressurized fluid 60 through the sprinkler 20 and an air release valve subassembly 250 in operative combination and to provide an adjustably weighted riser assembly 10 containing a reservoir 50 for containing pressurized fluid 60 that rapidly and easily forms sturdy, operative connections with such sprinkler 20, control valve 30 and air release valve subassembly 250.

The foregoing is considered as illustrative only of the principles of the invention. Further, since modifications and changes will occur to those skilled in the art, it is not desired to limit the invention to the exact construction and operation shown and described, and, accordingly, all suitable modifications and equivalents may be resorted to, falling within the scope of the invention. The materials used in construction of the assembly include metallic elements, metallic alloys, and polymers which provide strength, durability and rust resistance.

What is claimed is:

1. A riser assembly for use with a sprinkler, said assembly comprising:

a) a reservoir for containing a pressurized fluid, b) a container partially circumscribing said reservoir, said container having a fluid inlet and a fluid outlet disposed therethrough;

c) a secondary fluid outlet is disposed through said container, said secondary fluid outlet being operatively connected with means for selectively controlling flow of said fluid from said reservoir through said secondary fluid outlet;

d) a conduit circumscribing a channel occupiable by a signal carrier, said conduit including:

i) an intermediate conduit portion disposed within said reservoir, said intermediate conduit portion excluding said fluid within said reservoir from said channel;

ii) a first conduit portion operatively connected to said intermediate conduit portion and disposed through said container to a signal carrier entry area outside said container;

iii) a second conduit portion operatively connected to said intermediate conduit portion and disposed through said container to a signal carrier exit area outside said container; and wherein said signal carrier is disposable through said channel to carry a signal from outside said container through said channel to a signal processor situatable outside said container, said signal processor being operatively connectable to means for selectively controlling expulsion of said fluid through said sprinkler in response to said signal received by said signal processor through said signal carrier.

2. An assembly as in claim 1 wherein said means for selectively controlling flow of said fluid from said container through said secondary fluid outlet comprise a ball valve subassembly operatively connected to said secondary fluid outlet.

3. An assembly as in claim 1 wherein said secondary fluid outlet is operatively connected with a fluid drain valve.

4. An assembly as in claim 1 wherein said signal carrier is operatively connected through a cord to a connection plug.

5. An assembly as in claim 1 wherein said container and said conduit are composed of polyethylene and withstand at least 200 pounds of pressure per square inch.

6. An assembly as in claim 1 wherein:

a) said first conduit portion is disposed through a side wall of said container to said signal carrier entry area outside said container;

b) said second conduit portion is disposed through a top of said container to said signal carrier exit area outside said container; and wherein said signal carrier is disposable through said channel to carry said signal from outside said container through said channel for processing.

7. An assembly as in claim 1 wherein:

a) said first conduit portion is disposed through a first extrusion, said first extrusion being disposed outwardly away from an outer surface of said container; and b) said second conduit portion is disposed through a second extrusion, said second extrusion being disposed upwardly away from an upper surface of said container.

8. A riser assembly for use with a sprinkler, said assembly comprising:

a) a reservoir for containing a pressurized fluid, b) a container partially circumscribing said reservoir, said container having a fluid inlet and a fluid outlet disposed therethrough;

c) a secondary fluid outlet is disposed through said container, said secondary fluid outlet being operatively connected with means for selectively controlling flow of said fluid from said reservoir through said secondary fluid outlet;

d) a cover connectable to said container, said cover having an aperture for containing a sprinkler supply line disposed therethrough, a cavity being formed between said cover and said container;

e) a conduit circumscribing a channel occupiable by a signal carrier, said conduit including:

i) an intermediate conduit portion disposed within said reservoir, said intermediate conduit portion excluding said fluid within said reservoir from said channel;

ii) a first conduit portion operatively connected to said intermediate conduit portion and disposed through said container to a signal carrier entry area outside said container;

iii) a second conduit portion operatively connected to said intermediate conduit portion and disposed through said container to a signal carrier exit area outside said container; and wherein said signal carrier is disposable through said channel to carry a signal from outside said container through said channel to a signal processor situatable outside said container, said signal processor being operatively connectable to means for selectively controlling expulsion of said fluid through said sprinkler in response to said signal received by said signal processor through said signal carrier.

9. An assembly as in claim 8 wherein:

a) said signal carrier exit area is within said cavity; and b) said signal carrier is disposable through said channel to carry said signal from outside said container through said channel for processing within said cavity.

10. An assembly as in claim 8 wherein:

a) said first conduit portion is disposed through a side wall of said container to said signal carrier entry area outside said container;

b) said second conduit portion is disposed through a top of said container to said signal carrier exit area outside said container; and wherein said signal carrier is disposable through said channel to carry said signal from outside said container through said channel to said signal processor.

11. An assembly as in claim 8 wherein:

a) said first conduit portion is disposed through a first extrusion, said first extrusion being disposed outwardly away from an outer surface of said container; and b) said second conduit portion is disposed through a second extrusion, said second extrusion being disposed upwardly away from an upper surface of said container.

12. An assembly as in claim 8 wherein:

a) said fluid inlet is disposed through a side wall of said container;

b) said fluid outlet is disposed through a top of said container; and c) said cavity is formed between said cover and said top of said container.

13. An assembly as in claim 8 wherein said cover has disposed therethrough an opening coverable by a door, said door being selectively securable to said cover by a lock.

14. An assembly as in claim 8 wherein said means for selectively controlling flow of said fluid from said container through said secondary fluid outlet comprise a ball valve subassembly operatively connected to said secondary fluid outlet.

15. An assembly as in claim 8 wherein a secondary fluid outlet is disposed through said container, said secondary fluid outlet being operatively connected with a fluid drain valve.

16. An assembly as in claim 8 wherein said container and said conduit are composed of polyethylene and withstand at least 200 pounds of pressure per square inch.

* * * * *